US006484423B1

(12) United States Patent
Murray

(10) Patent No.: US 6,484,423 B1
(45) Date of Patent: Nov. 26, 2002

(54) DRAGLINE RIGGING SYSTEM

(75) Inventor: George Barnard Murray, Alberton (ZA)

(73) Assignee: Caterpillar Commercial SARL, Geneva (CH)

( * ) Notice: Subject to any disclaimer, the term of this patent is extended or adjusted under 35 U.S.C. 154(b) by 0 days.

(21) Appl. No.: 09/674,222

(22) PCT Filed: Jun. 13, 2000

(86) PCT No.: PCT/IB00/00782

§ 371 (c)(1),
(2), (4) Date: May 7, 2001

(87) PCT Pub. No.: WO01/25547

PCT Pub. Date: Apr. 12, 2001

(30) Foreign Application Priority Data

Oct. 5, 1999 (ZA) ..... 99/6316

(51) Int. Cl.[7] ..... E02F 3/58
(52) U.S. Cl. ..... 37/396; 37/397; 474/153
(58) Field of Search ..... 37/394, 396, 397, 37/401; 474/151, 152, 263, 153, 64; 294/82.11, 68.26, 112

(56) References Cited

U.S. PATENT DOCUMENTS 3,247,606 A 4/1966 Page
3,878,734 A * 4/1975 Zeldman et al.
4,037,485 A * 7/1977 Hoback
4,504,258 A 3/1985 Tanaka et al.
4,571,224 A * 2/1986 Arinaga
5,528,947 A * 6/1996 Wang et al.
5,584,771 A 12/1996 Isshiki et al.
5,779,584 A 7/1998 Noguchi
5,820,442 A * 10/1998 Helder
5,832,638 A 11/1998 Watts
5,956,936 A 9/1999 Ianello et al.

FOREIGN PATENT DOCUMENTS

AU B-6468/90 6/1991
EP 0 624 738 A1 11/1994

* cited by examiner

*Primary Examiner*—Christopher J. Novosad
(74) *Attorney, Agent, or Firm*—Kilpatrick Stockton LLP

(57) ABSTRACT

The invention relates to a dragline rigging system (10) which includes a pair of drag lines (12) connected to drag connection points (24) on a dragline bucket (18) for dragging the bucket through material to be excavated, a pair of hoist lines (14) connected to trunnions (30) on the dragline bucket for hoisting the bucket with excavated material during excavation, and a dump line (16) for lowering the front of the bucket (18) during dumping of excavated material. The dump line (16) is arranged to extend from the drag lines (12) over a pulley (52) linked to the hoist lines (14) and to a dump connection point (48) on the dragline bucket (18), and is in the form of a composite belt (42) which includes an inner material for receiving loads and an outer protective cover for resisting wear.

12 Claims, 1 Drawing Sheet

DRAGLINE RIGGING SYSTEM

BACKGROUND OF THE INVENTION

This invention relates to a dragline rigging system, and more specifically to a dump line for a dragline rigging.

Conventional dragline riggings include a pair of drag lines connectable to drag hitches on the cheeks of a dragline bucket for dragging the bucket through material to be excavated, a pair of hoist lines connectable to trunnions on side walls of the bucket for hoisting the bucket, and a dump rope for tipping the bucket. Generally, the hoist lines include a pair of lower hoist chains, a spreader bar for holding the lower hoist chains away from the bucket side walls during hoisting, and a pair of upper hoist chains for connecting the spreader bar to a pair of hoist ropes by way of a tri-link. To allow for tipping of the bucket, the dump rope is arranged to extend over a pulley linked to the hoist lines, and is connected at one end to the front of the bucket and at the other end to the drag lines.

The useful life of the dump rope in conventional rigging systems tends to be relatively short, typically only several weeks. The main reason for this is that, for practical reasons, the diameter of the pulley is limited and this limits the diameter of the dump rope which can be used with the pulley. If the diameter of the dump rope is too large, bending stresses in the rope as it passes over the pulley in use cause the rope to overstress and fail within a relatively short time. On the other hand, if the diameter of the rope is decreased to prevent premature failure of the rope due to bending stresses, the fatigue strength of the rope is generally insufficient to receive the dump-line loads for more than a few weeks.

Each time a dump rope on a dragline rigging is replaced, the down-time has a considerable effect on the productivity of the dragline. Accordingly, various proposals have been made to increase the durability of the ropes by for instance coating the ropes with a polyurethane coating or using special lubricants. However, none of these proposals have proved to substantially increase the useful life of a dump rope.

It is an object of the present invention to provide an alternative dump line for a dragline rigging which has a substantially increased useful life when compared with conventional dump ropes for dragline riggings.

SUMMARY OF THE INVENTION

According to the invention there is provided a dragline rigging system including:

- a pair of drag lines connected or connectable to drag connection points on a dragline bucket for dragging the bucket through material to be excavated;
- a pair of hoist lines connected or connectable to hoist connection points located at or near the rear of the dragline bucket for hoisting the bucket with excavated material during excavation; and
- a dump line which is arranged to extend from the drag lines over a pulley linked to the hoist lines and to a dump connection point located at or near the front of the dragline bucket for lowering the front of the bucket during dumping of excavated material, at least a substantial portion of the dump line comprising a composite belt which includes an inner material for receiving loads and an outer protective cover for resisting wear.

In a preferred embodiment of the invention, the inner material comprises a woven fabric or wire ropes, and the outer protective cover comprises a synthetic or natural rubber or a wear-resistant grade of polyurethane.

The composite belt may include a smooth or substantially smooth surface which is arranged to engage with a corresponding surface on a pulley.

Alternatively, the belt may include a plurality of teeth for engaging corresponding teeth on a pulley, or a series of centrally located projections which are arranged to run within a central slot in a pulley. In a particularly preferred embodiment, the pulley is formed from an engineering plastics such as NYLON, a fibreglass composite, or a combination of an engineering plastics and a fibreglass composite.

The invention also extends to a composite belt for a dump line on a dragline rigging system including a pair of drag lines and a pair of hoist lines, the composite belt having an inner material for receiving loads, an outer protective cover for resisting wear, a formation for attaching the belt to the drag lines, a formation for attaching the belt to a dump connection point located at or near the front of a dragline bucket, and an engaging surface for engaging a pulley linked to the hoist lines.

BRIEF DESCRIPTION OF THE DRAWINGS

The invention will now be described in more detail, by way of example only, with reference to the accompanying drawings in which.

DESCRIPTION OF THE PREFERRED EMBODIMENTS

Figure 1:
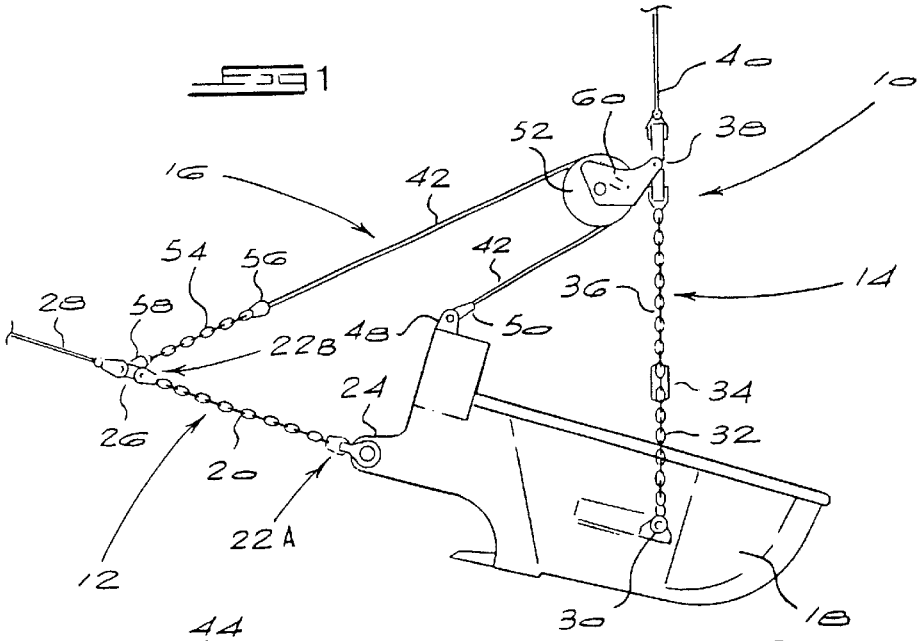
FIG. 1 shows a side view of a portion of a dragline with a rigging system according to the present invention.

A portion of a dragline rigging system according to the present invention is illustrated in FIG. 1. The rigging system is designated generally with the reference numeral 10 and includes a pair of drag lines 12, a pair of hoist lines 14 and a dump line 16 connected to a dragline bucket 18.

Forming part of the drag lines 12 is a pair of drag chains 20 which are connected at first ends 22A to drag connection points 24 on the cheeks of the dragline bucket and at second ends 22B to drag couplings 26 on a pair of drag ropes 28. Each drag rope is secured to a winding drum (not illustrated) so that rotation of the drum results either in the winding of the rope onto the drum so as to pull the dragline bucket 18 towards the drum through material to be excavated or the winding of the rope off the drum so as to allow the dragline bucket to be drawn away from the drum.

In a rear section of the dragline bucket 18 a pair of trunnions 30 provide attachment points for a pair of lower hoist chains 32 which form part of the hoist lines 14 and which extend between the trunnions and a spreader bar 34, as shown. Above the spreader bar, a pair of upper hoist chains 36 connect the spreader bar to a tri-link 38. The tri-link is also connected to a pair of hoist ropes 40 which pass over a pulley (not shown) on a dragline boom (also not shown) and which are connected to winding drums (which are not illustrated) for raising or lowering the bucket, as the case may be.

Figure 2:
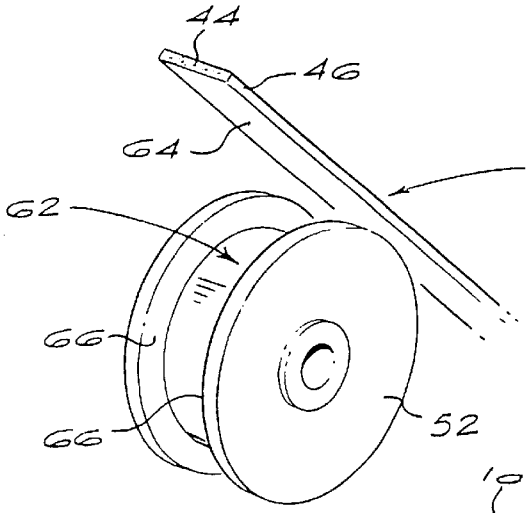
FIG. 2 shows a perspective view of a pulley and a portion of a composite belt according to one embodiment of the invention.

The dump line 16 in this embodiment of the invention is in the form of a composite belt 42 which is illustrated most clearly in FIG. 2 of the drawings. The composite belt 42 comprises a series of wire ropes 44 for receiving loads and a polyurethane cover 46 for protecting the wire ropes and resisting wear in use. The belt 42 is connected to a dump connection point 48 on the bucket 18 by means of a coupling 50 and extends over a pulley 52 to a pair of chains 54 which are connected to the belt with a coupling 56 and to the drag ropes 28 with couplings 58 (only one of which is visible in FIG. 1).

The pulley 52 forms part of a pulley-block 60 which is connected to the tri-link 38, as shown. In FIG. 2, the pulley 52 is seen to include a groove 62 which is shaped and sized to receive a surface 64 on the belt 42. In practice, the dump belt 42 runs within the groove of the pulley 52 as the dragline bucket is tipped during the discharge of excavated material and is restrained laterally by side walls 66 on either side of the groove 62.

Figure 3:
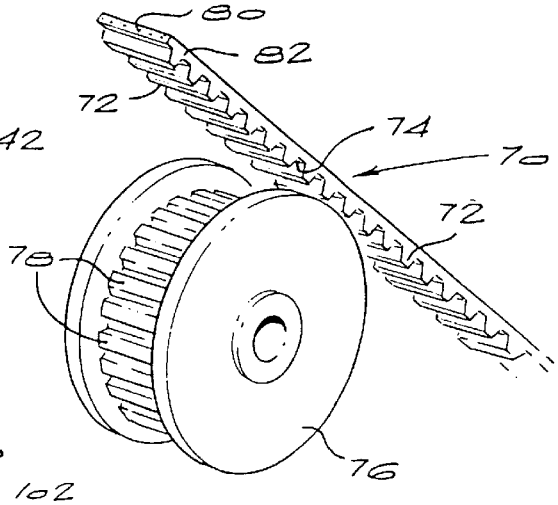
FIGS. 3 and 4 show perspective views similar to that of FIG. 2 of two further embodiments of the invention.

FIG. 3 of the drawings illustrates another embodiment of the composite belt forming part of the dragline rigging system of the invention. In this case, the belt 70 includes a plurality of teeth 72 on a surface 74, and a pulley 76 carries a series of corresponding teeth 78 which are arranged to mesh with the teeth 72 as the belt moves relative to the pulley during the tipping of excavated material. Similarly to the belt 42 of the first embodiment of the invention described above, the belt 70 includes a plurality of wire ropes 80 and a polyurethane cover 82.

Figure 4:
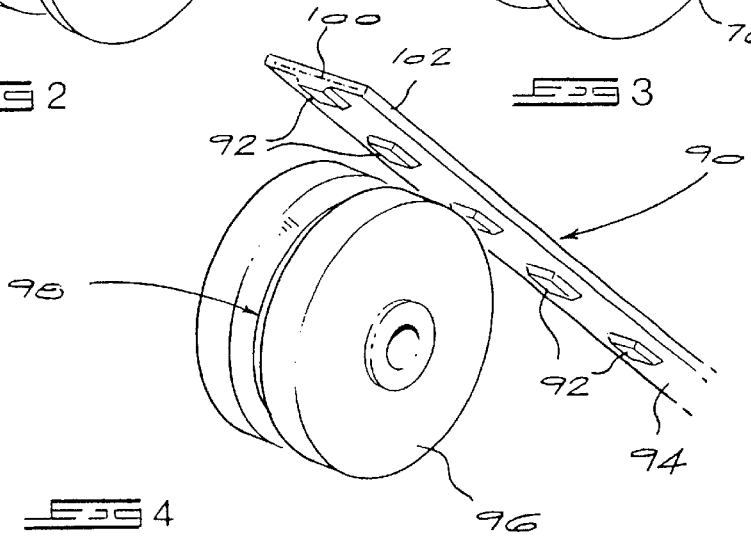

A further embodiment of the composite belt is illustrated in FIG. 4. In this arrangement, the composite belt 90 carries a number of projections 92 on a surface 94 thereof, and a pulley 96 defines a central groove 98 for receiving the projections 92 so as to provide lateral restraint for the belt as it passes over the pulley. Unlike the previous embodiments, in this case a woven fabric 100 is provided for receiving loads in use and is embedded within a polyurethane cover 102 which protects the belt against wear.

The pulleys 52, 76 and 96 are typically formed from an engineering plastics such as NYLON, but may also be formed from a fibreglass composite or a combination of an engineering plastics and a fibreglass composite, if desired.

A major advantage of the composite belt according to the embodiments of the invention described above is that it can carry sufficient wire rope or woven fabric for receiving loads in use, and at the same time is engageable with a relatively small pulley. Accordingly, the useful life of the dump line can be substantially extended when compared with conventional dump ropes without increasing the diameter of the pulley. The increased useful life of the dump line results in reduced down-time and consequently increases the productivity of the dragline.

What is claimed is:

1. A dragline rigging system including:

a pair of drag lines connected or connectable to drag connection points on a dragline bucket for dragging the bucket through material to be excavated;

a pair of hoist lines connected or connectable to hoist connection points located at or near the rear of the dragline bucket for hoisting the bucket with excavated material during excavation; and a dump line which is arranged to extend from the drag lines over a pulley linked to the hoist lines and to a dump connection point located at or near the from of the dragline bucket for lowering the front of the bucket during dumping of excavated material, the dump line including a composite belt having a first longitudinal end and a second longitudinal end, one or more inner load-bearing members extending from the first end to the second end for transferring loads from the first end to the second end, and an outer protective cover for resisting wear.

2. A dragline rigging system according to claim 1, wherein the one or more inner load-bearing members comprise one or more woven fabric or wire ropes, and the outer protective cover comprises a synthetic rubber, a natural rubber or a wear-resistant grade of polyurethane.

3. A dragline rigging system according to claim 1 wherein the composite belt includes a substantially smooth surface which is arranged to engage with a corresponding surface on a pulley.

4. A dragline rigging system according to either claim 1 wherein the composite belt includes a plurality of teeth which are arranged to engage corresponding teeth on a pulley.

5. A dragline rigging system according to either claim 1 wherein the composite belt includes a series of centrally located projections which are arranged to run within a central slot in a pulley.

6. A dragline rigging system according to claim 1 wherein the pulley is formed from an engineering plastics, a fibreglass composite, or a combination of an engineering plastics and a fibreglass composite.

7. A composite dump-line belt for a dragline rigging system including a pair of drag lines and a pair of hoist lines, the composite dump-line belt having a first longitudinal end and a second longitudinal end, one or more inner load-bearing members which extend from the first end to the second end for transferring loads from the first end to the second end, an outer protective cover for resisting wear, a formation for attaching the belt to the drag lines, a formation for attaching the belt to a dump connection point located at or near the front of a dragline bucket, and an engaging surface for engaging a pulley linked to the hoist lines.

8. A composite belt according to claim 7, wherein the one or more inner load-bearing members comprise one or more woven fabric or wire ropes, and the outer protective cover comprises a synthetic rubber, a natural rubber or a wear-resistant grade of polyurethane.

9. A composite belt according to claim 7 including a substantially smooth surface which is arranged to engage with a corresponding surface on the pulley.

10. A composite belt according to claim 7, including a plurality of teeth which are arranged to engage corresponding teeth on the pulley.

11. A composite belt according to claim 7, including a series of centrally located projections which are arranged to run within a central slot in the pulley.

12. A composite belt according to claim 7, wherein the pulley is formed from an engineering plastics, a fibreglass composite, or a combination of an engineering plastics and a fibreglass composite.

* * * * *